US007484926B2

(12) United States Patent
Suga et al.

(10) Patent No.: US 7,484,926 B2
(45) Date of Patent: Feb. 3, 2009

(54) STEAM TURBINE POWER PLANT

(75) Inventors: Takeo Suga, Yokohama (JP); Ryuichi Ishii, Edogawa-ku (JP); Takeo Takahashi, Yokohama (JP); Masafumi Fukuda, Saitama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 461 days.

(21) Appl. No.: 11/375,463

(22) Filed: Mar. 15, 2006

(65) Prior Publication Data

US 2006/0245911 A1 Nov. 2, 2006

(30) Foreign Application Priority Data

Apr. 28, 2005 (JP) ..... 2005-130966

(51) Int. Cl.
*F01D 25/26* (2006.01)
*F01D 1/00* (2006.01)

(52) U.S. Cl. ..... 415/108; 415/200; 415/220; 416/241 R; 420/37; 420/445; 420/446; 420/447; 420/448; 420/449; 420/450

(58) Field of Classification Search ..... 415/108, 415/200, 220; 416/241 R; 420/37, 445–450; 428/679, 680, 685
See application file for complete search history.

(56) References Cited

U.S. PATENT DOCUMENTS 5,997,806 A * 12/1999 Fujita et al. ..... 420/38
6,123,504 A * 9/2000 Shiga et al. ..... 415/200
6,730,264 B2 * 5/2004 Cao ..... 420/448
6,821,360 B2 * 11/2004 Ishii et al. ..... 148/333

FOREIGN PATENT DOCUMENTS

| | | |
|---|---|---|
| JP | 4-171202 | 6/1992 |
| JP | 3095745 | 8/2000 |
| JP | 2000-274208 | 10/2000 |
| JP | 2000-282805 | 10/2000 |
| JP | 2000-282807 | 10/2000 |
| JP | 2000-282808 | 10/2000 |
| JP | 2004-169562 | 6/2004 |
| JP | 3582848 | 8/2004 |

OTHER PUBLICATIONS

U.S. Appl. No. 11/375,463, filed mar. 15, 2006, Suga et al.
U.S. Appl. No. 11/282,851, filed Nov. 21, 2005, Suga et al.

* cited by examiner

*Primary Examiner*—Edward Look
*Assistant Examiner*—Sean J Younger
(74) *Attorney, Agent, or Firm*—Oblon, Spivak, McClelland, Maier & Neustadt, P.C.

(57) ABSTRACT

A steam turbine power plant which is provided with an extra-high-pressure turbine 100, a high-pressure turbine 200, an intermediate-pressure turbine 300 and a low-pressure turbine 400, and has high-temperature steam of 650° C. or more introduced into the extra-high-pressure turbine 100, wherein the extra-high-pressure turbine 100 has an outer casing cooling unit which cools an outer casing 111, and a turbine rotor 112, an inner casing 110 and a nozzle box 115 of the extra-high-pressure turbine 100 are formed of an Ni base heat-resisting alloy, and the outer casing 111 is formed of a ferrite-based alloy.

6 Claims, 5 Drawing Sheets

STEAM TURBINE POWER PLANT

CROSS-REFERENCE TO RELATED APPLICATIONS

This application is based upon and claims the benefit of priority from the prior Japanese Patent Application No. 2005-130966 filed on Apr. 28, 2005; the entire contents of which are incorporated herein by reference.

BACKGROUND

1. Field of the Invention

The present invention relates to a steam turbine power plant provided with a high-temperature steam turbine, and more particularly to a steam turbine power plant provided with a steam turbine which has individual configuration portions formed of a suitable heat-resisting alloy, a heat-resisting steel or the like.

2. Description of the Related Art

Energy saving of the thermal power system is being performed vigorously after the energy crisis, generation of $CO_2$ is being suppressed and needs for high efficiency are increasing in view of the global environmental protection in these years.

The conventional steam turbine power generation systems have a steam temperature of up to approximately 600° C., so that a ferrite-based heat-resisting steel is used for the main members such as a turbine rotor, a casing and the like of the steam turbine. In order to achieve the above-described energy saving and high efficiency, it is most effective for the steam turbine system to raise the steam temperature of the steam turbine to a high level to increase power generation efficiency.

But, in a case where the power generation efficiency is improved by raising the steam temperature of the steam turbine to, for example, 650° C. or more, it is hard to apply the structure of a conventional steam turbine power generation system as it is in view of the mechanical characteristics and environment resistance because the conventional steam turbine power generation system uses a ferrite-based heat-resisting steel for the main members such as a nozzle, a turbine rotor, a casing and the like of the steam turbine.

Under the circumstances described above, it is being studied to use an Ni base alloy, an austenite-based material or the like as a material of the turbine portions which are exposed to high-temperature steam in these years. The Ni base alloy and the austenite-based material are poor in workability, productivity and economical efficiency in comparison with the ferrite-based material. To use these materials for the turbine portions, various kinds of efforts have been made as disclosed in, for example, Japanese Patent Laid-Open Application No. Hei 4-171202, Japanese Patent No. 3095745, Japanese Patent No. 3582848, and Japanese Patent Laid-Open Applications No. 2000-274208, No. 2000-282805, No. 2000-282807, No. 2000-282808and No. 2004-169562. Among these disclosed technologies, it is being studied to use the turbine casing and the turbine rotor in a state divided into a high-temperature portion and a low-temperature portion in these years as disclosed in, for example, Japanese Patent Laid-Open Applications No. 2000-274208 and No. 2000-282808.

But, where the Ni base alloy or the austenite-based material is used to realize a highly efficient steam turbine power generation system, there are still problems that they are poor in economical efficiency in comparison with the ferrite-based material and also poor in productivity of a large steel ingot as described above.

BRIEF SUMMARY OF THE INVENTION

The present invention provides a steam turbine power plant provided with a steam turbine which can be operated by high-temperature steam of 650° C. or more by forming the individual configuration portions of the steam turbine by a preferable heat-resisting alloy, heat-resisting steel or the like.

According to an aspect of the present invention, there is provided a steam turbine power plant which is provided with an extra-high-pressure turbine, a high-pressure turbine, an intermediate-pressure turbine and a low-pressure turbine, and has high-temperature steam of 650° C. or more introduced into the extra-high-pressure turbine, wherein the extra-high-pressure turbine has a double-structured casing which is comprised of an outer casing and an inner casing, and an outer casing cooling unit which cools the outer casing by introducing cooling steam between the outer casing and the inner casing; a turbine rotor of the extra-high-pressure turbine is formed of a heat-resisting alloy which contains in percent by weight C: 0.10-0.20, Si: 0.01-0.5, Mn: 0.01-0.5, Cr: 20-23, Co: 10-15, Mo: 8-10, Al: 0.01-1.5, Ti: 0.01-0.6, B: 0.001-0.006 and the balance of Ni and unavoidable impurities, and it is suppressed in the unavoidable impurities that Fe is 5 or less, P is 0.015 or less, S is 0.015 or less and Cu is 0.5 or less; the inner casing and a nozzle box of the extra-high-pressure turbine are formed of a heat-resisting alloy which contains in percent by weight C: 0.03-0.25, Si: 0.01-1.0, Mn: 0.01-1.0, Cr: 20-23, Mo: 8-10, Nb: 1.15-3.0, and the balance of Ni and unavoidable impurities, and it is suppressed in the unavoidable impurities that Fe is 5 or less, P is 0.015 or less, S is 0.015 or less, and Cu is 0.5 or less; and the outer casing of the extra-high-pressure turbine is formed of a cast steel which contains in percent by weight C: 0.05-0.15, Si: 0.3 or less, Mn: 0.1-1.5, Ni: 1.0or less, Cr: 9 or more and less than 10, V: 0.1-0.3, Mo: 0.6-1.0, W: 1.5-2.0, Co: 1.0-4.0, Nb: 0.02-0.08, B: 0.001-0.008, N: 0.005-0.1, Ti: 0.001-0.03 and the balance of Fe and unavoidable impurities.

According to this steam turbine power plant, the turbine rotor, the inner casing and the nozzle box of the extra-high-pressure turbine are formed of the heat-resisting alloy having the above-described chemical composition range, and the outer casing which is cooled by the outer casing cooling unit is formed of the cast steel having the above-described chemical composition range, so that the high-temperature steam of 650° C. or more can be introduced into the extra-high-pressure turbine, and the thermal efficiency can be improved. Besides, the outer casing cooling unit is provided, and the outer casing is formed of the same ferrite-based alloy steel as a related art, so that reliability, operability and economical efficiency can be ensured.

According to another aspect of the present invention, there is provided a steam turbine power plant which is provided with an extra-high-pressure turbine, a high-pressure turbine, an intermediate-pressure turbine and a low-pressure turbine, and has high-temperature steam of 650° C. or more introduced into the extra-high-pressure turbine, wherein the extra-high-pressure turbine has a double-structured casing which is comprised of an outer casing and an inner casing, an outer casing cooling unit which cools the outer casing by introducing cooling steam between the outer casing and the inner casing, and a turbine rotor cooling unit which cools a turbine rotor by the cooling steam; a turbine rotor of the extra-high-pressure turbine is formed of a heat-resisting steel which contains in percent by weight C: 0.08-0.15, Si: 0.1 or less, Mn: 0.1-0.3, Ni: 0.1-0.3, Cr: 9 or more and less than 10, V: 0.15-0.3, Mo: 0.4-1.0, W: 1.5-2.0, Co: 1.0-4.0, Nb: 0.05-0.08, B: 0.001-0.015, N: 0.01-0.04 and the balance of Fe and unavoidable impurities; the inner casing and a nozzle box of the extra-high-pressure turbine are formed of a heat-resisting alloy which contains in percent by weight C: 0.03-0.25, Si: 0.01-1.0, Mn: 0.01-1.0, Cr: 20-23, Mo: 8-10, Nb: 1.15-3.0 and the balance of Ni and unavoidable impurities, and it is suppressed in the unavoidable impurities that Fe is 5 or less, P is 0.015 or less, S is 0.015 or less, and Cu is 0.5 or less; and the outer casing of the extra-high-pressure turbine is formed of a cast steel which contains in percent by weight C: 0.05-0.15, Si: 0.3 or less, Mn: 0.1-1.5, Ni: 1.0 or less, Cr: 9 or more and less than 10, V: 0.1-0.3, Mo: 0.6-1.0, W: 1.5-2.0, Co: 1.0-4.0, Nb: 0.02-0.08, B: 0.001-0.008, N: 0.005-0.1, Ti: 0.001-0.03 and the balance of Fe and unavoidable impurities.

According to this steam turbine power plant, the inner casing and the nozzle box of the extra-high-pressure turbine each are formed of the heat-resisting alloy having the above-described chemical composition range, the turbine rotor which is cooled by the turbine rotor cooling unit is formed of the heat-resisting steel having the above-described chemical composition range, and the outer casing which is cooled by the outer casing cooling unit is formed of the cast steel having the above-described chemical composition range, so that the high-temperature steam of 650° C. or more can be introduced into the extra-high-pressure turbine, and the thermal efficiency can be improved. Besides, the turbine rotor cooling unit and the outer casing cooling unit are provided, and the turbine rotor and the outer casing are formed of the same ferrite-based alloy steel as that of a related art, so that reliability, operability and economical efficiency can be ensured.

According to still another aspect of the present invention, there is provided a steam turbine power plant which is provided with an extra-high-pressure turbine, a high-pressure turbine, an intermediate-pressure turbine and a low-pressure turbine, and has high-temperature steam of 650° C. or more introduced into the extra-high-pressure turbine, wherein the extra-high-pressure turbine has a double-structured casing which is comprised of an outer casing and an inner casing, an outer casing cooling unit which cools the outer casing by introducing cooling steam between the outer casing and the inner casing, a turbine rotor cooling unit which cools a turbine rotor by the cooling steam, and an inner casing cooling unit which cools the inner casing by the cooling steam; a turbine rotor of the extra-high-pressure turbine is formed of a heat-resisting steel which contains in percent by weight C: 0.08-0.15, Si: 0.1 or less, Mn: 0.1-0.3, Ni: 0.1-0.3, Cr: 9 or more and less than 10, V: 0.15-0.3, Mo: 0.4-1.0, W: 1.5-2.0, Co: 1.0-4.0, Nb: 0.05-0.08, B: 0.001-0.015, N: 0.01-0.04 and the balance of Fe and unavoidable impurities; a nozzle box of the extra-high-pressure turbine is formed of a heat-resisting alloy which contains in percent by weight C: 0.03-0.25, Si: 0.01-1.0, Mn: 0.01-1.0, Cr: 20-23, Mo: 8-10, Nb: 1.15-3.0 and the balance of Ni and unavoidable impurities, and it is suppressed in the unavoidable impurities that Fe is 5 or less, P is 0.015 or less, S is 0.015 or less, and Cu is 0.5 or less; and the inner casing and the outer casing of the extra-high-pressure turbine are formed of a cast steel which contains in percent by weight C: 0.05-0.15, Si: 0.3 or less, Mn: 0.1-1.5, Ni: 1.0 or less, Cr: 9 or more and less than 10, V: 0.1-0.3, Mo: 0.6-1.0, W: 1.5-2.0, Co: 1.0-4.0, Nb: 0.02-0.08, B: 0.001-0.008, N: 0.005-0.1, Ti: 0.001-0.03 and the balance of Fe and unavoidable impurities.

According to this steam turbine power plant, the nozzle box of the extra-high-pressure turbine is formed of the heat-resisting alloy having the above-described chemical composition range, the turbine rotor which is cooled by the turbine rotor cooling unit is formed of the heat-resisting steel having the above-described chemical composition range, and the inner casing which is cooled by the inner casing cooling unit and the outer casing which is cooled by the outer casing cooling unit are formed of the cast steel having the above-described chemical composition range, so that the high-temperature steam of 650° C. or more can be introduced into the extra-high-pressure turbine, and the thermal efficiency can be improved. Besides, the turbine rotor cooling unit, the inner casing cooling unit and the outer casing cooling unit are provided, the turbine rotor, the inner casing and the outer casing are formed of the same ferrite-based alloy steel as that of a related art, so that reliability, operability and economical efficiency can be ensured.

BRIEF DESCRIPTION OF THE DRAWINGS

The present invention is described with reference to the drawings, which are provided for illustration only and do not limit the present invention in any respect.

DETAILED DESCRIPTION OF THE INVENTION

Embodiments of the present invention will be described with reference to the drawings.

First Embodiment

Figure 1:
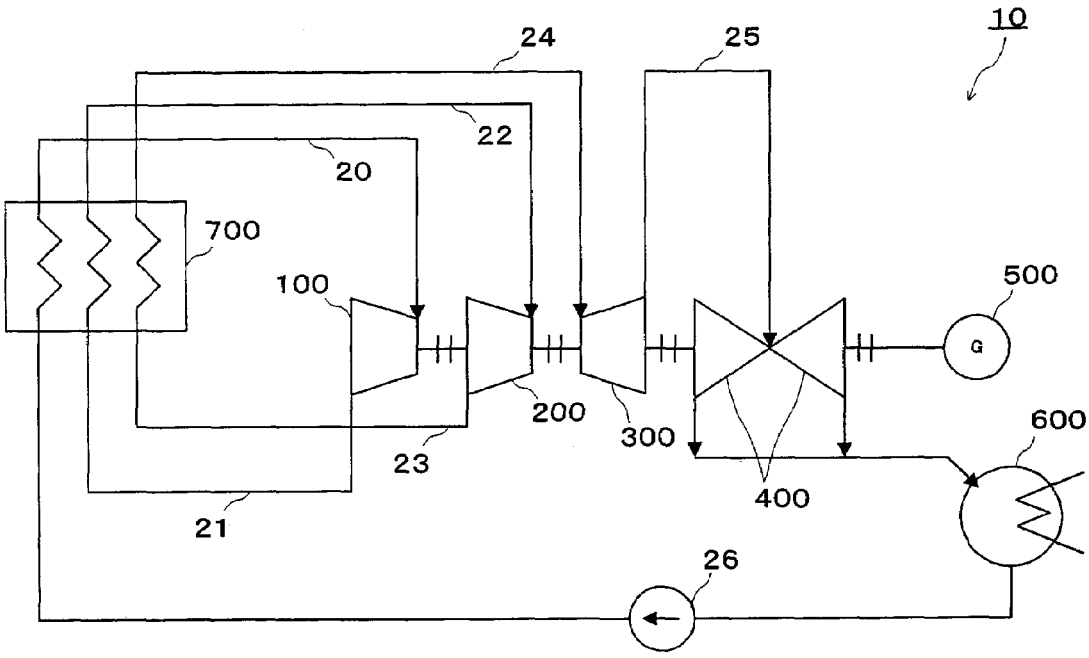
FIG. 1 is a diagram schematically showing an overview of the steam turbine power generation system according to a first embodiment of the present invention.
Figure 2:
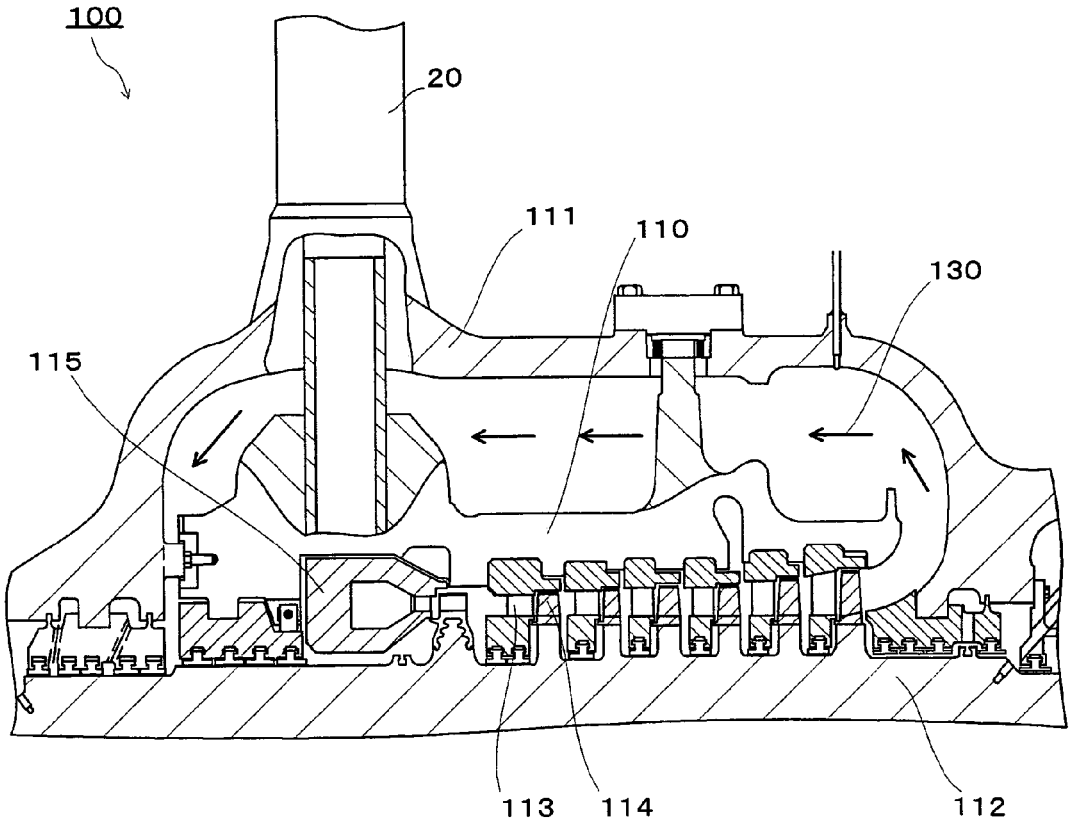
FIG. 2 is a sectional view of an upper-half casing portion of an extra-high-pressure turbine.

FIG. 1 shows schematically an overview of a steam turbine power generation system 10 of a first embodiment. FIG. 2 shows a sectional view of an upper-half casing portion of an extra-high-pressure turbine 100.

The overview of the steam turbine power generation system 10 will be described with reference to FIG. 1.

The steam turbine power generation system 10 is mainly comprised of the extra-high-pressure turbine 100, a high-pressure turbine 200, an intermediate-pressure turbine 300, a low-pressure turbine 400, a generator 500, a condenser 600, and a boiler 700.

Subsequently, an operation of steam in the steam turbine power generation system 10 will be described.

Steam which is heated to a temperature of 650° C. or more in the boiler 700 is flown into the extra-high-pressure turbine 100 through a main steam pipe 20. Where the moving blades of the extra-high-pressure turbine 100 are configured in, for example, seven stages, the steam having performed an expansion work in the extra-high-pressure turbine 100 is discharged through a seventh stage outlet and flown into the boiler 700 through a low-temperature reheating pipe 21. The boiler 700 reheats the steam having entered the boiler 700, and the reheated steam enters the high-pressure turbine 200 through a high-temperature reheating pipe 22.

Where the moving blades of the high-pressure turbine 200 are configured in, for example, seven stages, steam having entered the high-pressure turbine 200 performs an expansion work in the high-pressure turbine 200. Then, it is discharged through the seventh stage outlet and flown into the boiler 700 through a low-temperature reheating pipe 23. The boiler 700 reheats the steam having entered the boiler 700, and the reheated steam enters the intermediate-pressure turbine 300 through a high-temperature reheating pipe 24.

Where the moving blades of the intermediate-pressure turbine 300 are configured in, for example, seven stages, the steam having entered the intermediate-pressure turbine 300 performs an expansion work in the intermediate-pressure turbine 300. Then, it is discharged from the seventh stage outlet and supplied to the low-pressure turbine 400 through a cross-over pipe 25.

The steam supplied to the low-pressure turbine 400 performs an expansion work and is condensed into water by the condenser 600. The condensate has its pressure increased by a boiler feed pump 26 and is circulated to the boiler 700. The condensate circulated to the boiler 700 is heated to become high-temperature steam of 650° C. or more and supplied again to the extra-high-pressure turbine 100 through the main steam pipe 20. The generator 500 is driven to rotate by the expansion works of the individual steam turbines to generate electric power. It should be noted that the low-pressure turbine 400 described above has two low-pressure turbine sections having the same structure tandem-connected but is not limited to the described structure.

Then, a structure of the extra-high-pressure turbine 100 will be described with reference to FIG. 2.

The extra-high-pressure turbine 100 has a double-structured casing which is comprised of an inner casing 110 and an outer casing 111 which is disposed to cover it. A turbine rotor 112 is disposed through the inner casing 110. For example, a seven stage nozzle 113 is disposed on the inner surface of the inner casing 110, and moving blades 114 are implanted in the turbine rotor 112. Besides, the main steam pipe 20 is disposed on the extra-high-pressure turbine 100 through the outer casing 111 and the inner casing 110, and an end of the main steam pipe 20 is connected to communicate with a nozzle box 115 which discharges steam toward the moving blades 114.

The extra-high-pressure turbine 100 is also provided with an outer casing cooling unit which cools the outer casing 111 by introducing part of the steam having performed the expansion work between the inner casing 110 and the outer casing 111 as cooling steam 130.

Subsequently, an operation of steam in the extra-high-pressure turbine 100 will be described.

The steam having a temperature of 650° C. or more, which has flown into the nozzle box 115 within the extra-high-pressure turbine 100 through the main steam pipe 20, rotates the turbine rotor 112 by flowing through the steam passage between the nozzle 113 fixed to the inner casing 110 and the moving blades 114 implanted in the turbine rotor 112. A large force is applied to the individual portions of the turbine rotor 112 by the great centrifugal action due to the rotations. And, the steam having performed the expansion work is mostly discharged and enters the boiler 700 through the low-temperature reheating pipe 21. Meanwhile, the steam having performed the expansion work is partly guided as the cooling steam 130 between the inner casing 110 and the outer casing 111 to cool the outer casing 111. The cooling steam 130 is discharged from a ground portion or a discharge path where the steam having performed the expansion work is mostly discharged.

The constituent material of the inner casing 110, the outer casing 111, the turbine rotor 112 and the nozzle box 115 which configure the extra-high-pressure turbine 100 will be described below. It should be noted that the ratio of chemical compositions shown below is expressed in "% by weight" unless otherwise specified.

(1) Turbine Rotor 112

For a material configuring the turbine rotor 112, a heat-resisting alloy (M1) having the following chemical composition range is used.

(M1) Heat-resisting alloy which contains C: 0.10-0.20, Si: 0.01-0.5, Mn: 0.01-0.5, Cr: 20-23, Co: 10-15, Mo: 8-10, Al: 0.01-1.5, Ti: 0.01-0.6, B: 0.001-0.006, and the balance of Ni and unavoidable impurities; and the unavoidable impurities are suppressed to contain Fe: 5 or less, P: 0.015 or less, S: 0.015 or less, and Cu: 0.5 or less.

Then, the reasons of limiting the individual components of the heat-resisting alloy to the above-described ranges will be described.

(a) C (Carbon)

C is indispensable as a component element of $M_{23}C_6$ type carbide which is a strengthening phase, and particularly, it serves to maintain the creep strength of the alloy by precipitating the $M_{23}C_6$ type carbide during the operation of the turbine in a high-temperature environment of 650° C. or more. If its additive rate is less than 0.10%, the disposition amount of the $M_{23}C_6$ type carbide is not sufficient, and a desired creep strength cannot be assured, and if the additive rate exceeds 0.20%, the tendency of segregation of components increases at the time of producing a large ingot, and the generation of M6C type carbide which is an embrittlement phase is promoted. Therefore, the additive rate of C is determined to be 0.10-0.20%.

(b) Si (Silicon)

Si has a deoxidizing effect and improves cleanness of the ingot. But, if its addition exceeds 0.5%, the ductility of the alloy is reduced, and embrittlement in a high-temperature environment of 650° C. or more is accelerated. And, if its addition is less than 0.01%, the deoxidizing effect is not attained, and the fluidity of a molten metal when the ingot is produced is decreased. Therefore, the additive rate of Si is determined to be 0.01-0.5%.

(c) Mn (Manganese)

Mn has a desulfurizing effect and enhances cleanness of the ingot. But, if its addition exceeds 0.5%, Mn which remains as sulfides in the ingot increases considerably. If its addition is less than 0.01%, the desulfurizing effect is not obtained. Therefore, the additive rate of Mn is determined to be 0.01-0.5%.

(d) Cr (Chrome)

Cr is indispensable as a component element of the $M_{23}C_6$ type carbide, and particularly, the creep strength of the alloy is maintained by precipitating the $M_{23}C_6$ type carbide during the operation of the turbine in a high-temperature environment of 650° C. or more. And, Cr improves the resistance to oxidation in a high-temperature steam environment. If its additive rate is less than 20%, the resistance to oxidation decreases, and if the additive rate exceeds 23%, precipitation of the $M_{23}C_6$ type carbide is accelerated considerably, resulting in increasing the tendency of coarsening. Therefore, the additive rate of Cr is determined to be 20-23%.

(e) Co (Cobalt)

Co provides an effect of forming a solid solution in an Ni mother phase to improve the stability of the mother phase at a high temperature and suppresses the $M_{23}C_6$ type carbide from coarsening. If its addition is less than 10%, the turbine rotor cannot exert desired characteristics, and if its addition exceeds 15%, formability of a large ingot is decreased, and economical efficiency is degraded. Therefore, the additive rate of Co is determined to be 10-15%.

(f) Mo (Molybdenum)

Mo provides an effect of forming a solid solution in an Ni mother phase to enhance the strength of the mother phase, and its partial substitution in the $M_{23}C_6$ type carbide enhances the stability of the carbide. If its addition is less than 8%, the above effect is not exerted, and if its addition exceeds 10%, a tendency of segregation of components at the time of producing a large ingot is increased, and the generation of M6C type carbide which is an embrittlement phase is accelerated. Therefore,the additive rate of Mo is determined to be 8-10%.

(g) Al (Aluminum)

Al is mainly added to effect deoxidization. Al configures a γ' phase in Ni and might contribute to enhancement of precipitation. But a precipitation amount of the γ' phase in the alloy is not so large that effective enhancement of precipitation can be expected, but because it is an active metal element, productivity in a melting step and in ingot production is degraded. Especially, where a relatively large ingot, such as a turbine rotor, is produced, the above characteristics become conspicuous if the additive rate exceeds 1.5%. And, if the additive rate is less than 0.01%, the deoxidizing effect cannot be obtained. Therefore, the additive rate of Al is determined to be 0.01-1.5%.

(h) Ti (Titanium)

Ti is mainly added to effect deoxidization. Ti configures a γ' phase in Ni and might contribute to enhancement of precipitation. But a precipitation amount of the γ' phase in the alloy is not so large that effective enhancement of precipitation can be expected, but because it is an active metal element, productivity in a melting step and ingot production is degraded. Especially, where a relatively large ingot, such as a turbine rotor, is produced, the above characteristics become conspicuous if the additive rate exceeds 0.6%. And, if the additive rate is less than 0.01%, the deoxidizing effect cannot be obtained. Therefore, the additive rate of Ti is determined to be 0.01-0.6%.

(i) B (Boron)

Bis partly substituted in $M_{23}C_6$type carbide which is a strengthening phase and provides effects of enhancing the stability of carbide at a high temperature and also enhancing ductility of the mother phase especially in the vicinity of grain boundary at a high temperature. These effects are exerted by addition of B in a very small amount of 0.001% ormore, but if the addition exceeds 0.006%, a tendency of segregation of components in a large ingot increases, deformation resistance when forging becomes high, and a forging crack is caused easily. Therefore, the additive rate of B is determined to be 0.001-0.006%.

(j) Fe (Iron), P (Phosphorus), S (Sulfur), Cu (Copper)

In the alloy specified as a turbine rotor material, various types of unavoidable impurities are mingled and remain in it. Among them, especially four elements Fe, P, S and Cu are determined their upper limits. Addition of P and S is limited up to 0.015% so that embrittlement due to grain boundary segregation in a high-temperature environment can be suppressed, and Cu is limited to maximum of 0.5% which does not affect on the characteristics because it is mingled unavoidably in steelmaking. And, in a case where a large melting furnace that normally melts steel having Fe as a main component element is used, mingling of Fe at the time of melting is unavoidable when an alloy to which Fe is not added intentionally is melted, and the upper limit of Fe is determined to be 5% which does not affect on the characteristics. These unavoidable impurities are preferably decreased as low as industrially possible to a mixing rate of 0%.

(2) Inner Casing 110, Nozzle Box 115

As a material configuring the inner casing 110 and the nozzle box 115, a heat-resisting alloy (M2) having the following chemical composition range is used.

(M2) Heat-resisting alloy which contains C: 0.03-0.25, Si: 0.01-1.0, Mn: 0.01-1.0, Cr: 20-23, Mo: 8-10, Nb: 1.15-3.0, and the balance of Ni and unavoidable impurities; and the unavoidable impurities are suppressed to contain Fe: 5 or less, P: 0.015 or less, S: 0.015 or less, and Cu: 0.5 or less.

Then, the reasons of limiting the individual components of the heat-resisting alloy to the above-described ranges will be described.

(a) C (Carbon)

C is useful as a component element of the $M_{23}C_6$ type carbide which is a strengthening phase, and particularly, the creep strength of the alloy is maintained by precipitating the $M_{23}C_6$ type carbide during the operation of the turbine in a high-temperature environment of 650° C. or more. Because the inner casing 110 is produced as a large cast product, the fluidity of the molten metal is required at the time of casting, and C also has an effect of assuring the fluidity of the molten metal. If its additive rate is less than 0.03%, a sufficient disposition amount of the carbide cannot be assured, and the fluidity of the molten metal at the time of casting is degraded considerably. If the addition exceeds 0.25%, the tendency of segregation of components increases at the time of producing a large ingot, and the generation of M6C type carbide which is an embrittlement phase is promoted. Therefore, the additive rate of C is determined to be 0.03-0.25%.

(b) Si (Silicon)

Si has a deoxidizing effect and also has an effect of assuring the fluidity of the molten metal. In a case where a large cast product is produced, a molten metal obtained by melting in the atmosphere is cast in the atmosphere. Therefore, deoxidization is more significant than when a ingot is produced by casting in vacuum, and the fluidity of the molten metal is particularly significant at the time of producing a large cast product. But, if the addition exceeds 1.0%, deterioration of ductility of the alloy and embrittlement in a high-temperature environment at 650° C. or more are accelerated considerably. And, if its addition is less than 0.01%, the deoxidizing effect is not attained, and the fluidity of the molten metal at the time of production of the ingot lowers. Therefore, the additive rate of Si is determined to be 0.01-1.0%.

(c) Mn (Manganese)

Mn has a desulfurizing effect and an effect of increasing the fluidity of a molten metal. These effects are significant in the production of a large cast product which is obtained by casting in the atmosphere the molten metal which is obtained by melting in the atmosphere. But, if the addition exceeds 1.0%, deterioration of ductility of the alloy and embrittlement in a high-temperature environment at 650° C. or more are accelerated considerably. And, if its addition is less than 0.01%, the desulfurizing effect is not attained. Therefore, the additive rate of Mn is determined to be 0.01-1.0%.

(d) Cr (Chrome)

Cr is indispensable as a component element of the $M_{23}C_6$ type carbide, and particularly, the creep strength of the alloy is maintained by precipitating the $M_{23}C_6$ type carbide during the operation of the turbine in a high-temperature environment of 650° C. or more. And, Cr improves the resistance to oxidation in a high-temperature steam environment. If its additive rate is less than 20%, the resistance to oxidation decreases, and if the additive rate exceeds 23%, precipitation of the $M_{23}C_6$ type carbide is accelerated considerably, resulting in increasing the tendency of coarsening. Therefore, the additive rate of Cr is determined to be 20-23%.

(e) Mo (Molybdenum)

Mo provides an effect of forming a solid solution into an Ni mother phase to enhance the strength of the mother phase, and its partial substitution in the $M_{23}C_6$ type carbide enhances the stability of the carbide. If its addition is less than 8%, the above effect is not exerted, and if its addition exceeds 10%, a tendency of segregation of components increases when a large ingot is produced, and the generation of M6C type carbide which is an embrittlement phase is accelerated. Therefore, the additive rate of Mo is determined to be 8-10%.

(f) Nb (Niobium)

Nb is mainly added as a component element of a γ" phase and a δ phase which contribute to enhancement of precipitation. If its additive rate is less than 1.15%, the precipitation amounts of the γ" phase and the δ phase are insufficient, and particularly, creep strength decreases. Meanwhile, if the addition exceeds 3.0%, the precipitation amounts of the γ" phase and the δ phase in a high-temperature environment of 650° C. or more increase sharply, and considerable embrittlement is caused in a short time. And, a tendency of segregation of components when a large cast product is produced becomes considerable. Therefore, the additive rate of Nb is determined to be 1.15-3.0%.

(g) Fe (Iron), P (Phosphorus), S (Sulfur), Cu (Copper)

In an alloy which is specified as a material for the inner casing 110 and the nozzle box 115, many types of unavoidable impurities are mingled and remained. Among them, four elements of Fe, P, S and Cu are determined their upper limits. P and S is determined to be 0.015% as the upper limit capable of suppressing embrittlement caused by grain boundary segregation in a high-temperature environment, and the upper limit of Cu is determined to be 0.5% which does not affect on the characteristics because Cu is unavoidably mingled in steelmaking. Where a large melting furnace, which is normally used to melt steel containing Fe as a main component element, is used to melt an alloy to which Fe is not added intentionally, mingling of Fe is unavoidable when melting. Therefore, its upper limit is determined to be 5% which does not affect on the characteristics. These unavoidable impurities are preferably decreased as low as industrially possible to a mixing rate of 0%.

(3) Outer Casing 111

As a material configuring the outer casing 111, a cast steel (M3) having the following chemical composition range is used.

(M3) Cast steel which contains C: 0.05-0.15, Si: 0.3 or less, Mn: 0.1-1.5, Ni: 1.0 or less, Cr: 9 or more and less than 10, V: 0.1-0.3, Mo: 0.6-1.0, W: 1.5-2.0, Co: 1.0-4.0, Nb: 0.02-0.08, B: 0.001-0.008, N: 0.005-0.1, Ti: 0.001-0.03, and the balance of Fe and unavoidable impurities.

The outer casing 111 is cooled by an outer casing cooling unit, so that the above-described ferrite-based cast steel which excels in productivity in casting or the like can be used. As the cast steel having basic components in the above range, for example, Japanese Patent Laid-Open Application No. 2005-60826 describes" (M11) alloy steel which contains C: 0.05-0.15, Si: 0.3 or less (not including 0), Mn: 0.1-1.5, Ni: 1.0 or less (not including 0), Cr: 9.0 or more and less than 10, V: 0.1-0.3, Mo: 0.6-1.0, W: 1.5-2.0, Co: 1.0-4.0, Nb: 0.02-0.08, B: 0.001-0.008, N: 0.005-0.1, Ti: 0.001-0.03, and the balance of Fe and unavoidable impurities; $M_{23}C_6$ type carbide is mainly precipitated on grain boundary and martensite lath boundary by a tempering heat treatment; $M_2X$ type carbonitride and MX type carbonitride are precipitated within the martensite lath; V and Mo contained in the component elements of the $M_2X$ type carbonitride have a relation of V>Mo; and a total precipitate of the $M_{23}C_6$ type carbide, the $M_2X$ type carbonitride and the MX type carbonitride is 2.0-4.0% by weight".

It will be described in Example 1 that, even if the material configuring the above-described turbine rotor 112, the inner casing 110 and the nozzle box 115 is exposed to a temperature of 650° C or more, desired mechanical characteristics can be exerted, and the material having a successive change is resistant to an actual operation.

It will be described in Example 2 that even if the above-described material configuring the outer casing 111 is exposed to a temperature of 600° C, desired mechanical characteristics can be exerted, and the material having a successive change is also resistant to an actual operation. Here, the test temperature of the outer casing 111 is set to 600° C, because the outer casing 111 is cooled by the outer casing cooling unit, and the desired mechanical characteristics can exert at a temperature of approximately 600° C, and if the material having a successive change is resistant to an actual operation, it can be judged that the outer casing 111 can operate properly even if high-temperature steam of 650° C or more is introduced into the extra-high-pressure turbine 100.

EXAMPLE 1

Table 1 shows chemical compositions of materials (material PA1 through material PA4) configuring the turbine rotor 112, the inner casing 110 and the nozzle box 115, and chemical compositions of materials (material CA1 through material CA4) as comparative examples which are not in the ranges of the chemical compositions according to the invention. Here, as the material configuring the turbine rotor 112, the material PA1 and the material PA2 are used, and as the material configuring the inner casing 110 and the nozzle box 115, the material PA3 and the material PA4 are used. The material PA1 and the material PA2 are configured of the heat-resisting alloy having the chemical composition range of the material (M1) configuring the above-described turbine rotor 112, and the material PA3 and the material PA4 are configured of the heat-resisting alloy having the chemical composition range of the material (M2) configuring the above-described inner casing 110 and the nozzle box 115.

The above-described individual materials having undergone a prescribed heat treatment were heated at 700° C. for 10,000 hours; then a 0.2% proof stress at room temperature, an absorbed energy at 20° C. and a creep rupture strength at 700° C. for 100,000 hours were measured.

Table 2 shows values obtained by dividing the values after heating in the individual measurements by the values before heating. Here, a value obtained by dividing the 0.2% proof stress at room temperature after heating at 700° C. for 10,000 hours by a 0.2% proof stress at room temperature before heating is determined as an index 1, a value obtained by dividing the absorbed energy at 20° C. after heating at 700° C. for 10,000 hours by an absorbed energy at 20° C. before heating is determined as an index 2, and a value obtained by dividing the creep rupture strength at 700° C. for 100,000 hours after heating at 700° C. for 10,000 hours by a creep rupture strength at 700° C. for 100,000 hours before heating is determined as an index 3.

It is seen from the results shown in Table 2 that the absorbed energy at 20° C. of the material PA1 through the material PA4 after heating at 700° C. for 10,000 hours becomes lower than that before heating, but the 0.2% proof stress at room temperature is secured at a level of at least about 1.4 times higher than that before heating. It is also found that the most significant creep rupture strength of the high-temperature parts was maintained substantially at a level of that before heating.

Meanwhile, the material CA1 and the material CA2 which are not in the range of the chemical compositions of the invention have values of a 0.2% proof stress at roomtemperature, an absorbed energy at 20° C., and a creep rupture strength at 700° C. for 100,000 hours after heating lower than those before heating, and particularly have considerably lowered values of a creep rupture strength at 700° C. for 100,000 hours. And, the material CA3 and the material CA4 have values of a 0.2% proof stress at room temperature after heating higher than those before heating, but have considerably lowered values of an absorbed energy at 20° C., and it is also found that the material CA4 did not keep the value of a creep rupture strength at 700° C. for 100,000 hours at the same level as in the above-described example.

TABLE 1

| | Example | | | | Comparative Example | | | |
|---|---|---|---|---|---|---|---|---|
| | PA1 | PA2 | PA3 | PA4 | CA1 | CA2 | CA3 | CA4 |
| C | 0.12 | 0.18 | 0.08 | 0.21 | 0.04 | 0.05 | 0.06 | 0.08 |
| Si | 0.45 | 0.33 | 0.47 | 0.42 | 0.04 | 0.09 | 0.28 | 0.37 |
| Mn | 0.42 | 0.37 | 0.41 | 0.33 | 0.03 | 0.15 | 0.41 | 0.33 |
| P | 0.011 | 0.008 | 0.012 | 0.005 | 0.010 | 0.009 | 0.010 | 0.007 |
| S | 0.008 | 0.005 | 0.006 | 0.002 | 0.007 | 0.005 | 0.004 | 0.007 |
| Ni | Balance | Balance | Balance | Balance | 53.3 | 43.2 | Balance | Balance |
| Cr | 21.8 | 22.4 | 21.5 | 21.7 | 18.2 | 12.9 | 21.6 | 22.0 |
| Mo | 9.1 | 9.1 | 9.2 | 8.9 | 3.1 | 6.2 | 8.98 | 9.05 |
| V | — | — | — | — | — | — | — | — |
| W | — | — | — | — | — | — | — | — |
| Nb | — | — | 2.55 | 1.72 | 5.04 | — | — | 3.52 |
| N | — | — | — | — | — | — | — | — |
| Al | 0.72 | <0.01 | <0.01 | <0.01 | 0.51 | 0.21 | 1.22 | 0.19 |
| Ti | 0.31 | <0.01 | <0.01 | <0.01 | 1.03 | 2.48 | 0.02 | 0.21 |
| B | 0.004 | 0.003 | — | — | 0.004 | 0.014 | 0.005 | — |
| Co | 12.3 | 11.4 | <0.01 | <0.01 | <0.01 | — | 12.4 | <0.01 |
| Cu | 0.02 | 0.01 | 0.03 | 0.02 | <0.01 | <0.01 | 0.01 | 0.01 |
| Fe | 1.25 | 2.06 | 2.23 | 3.47 | Balance | Balance | 1.54 | 3.05 |

TABLE 2

| | Index 1 | Index 2 | Index 3 |
|---|---|---|---|
| PA1 | 1.44 | 0.35 | 0.95 |
| PA2 | 1.64 | 0.26 | 0.92 |
| PA3 | 2.05 | 0.20 | 1.0 |
| PA4 | 1.53 | 0.24 | 0.95 |
| CA1 | 0.65 | 0.17 | 0.6 |
| CA2 | 0.71 | 0.14 | 0.3 |
| CA3 | 1.48 | 0.08 | 0.95 |
| CA4 | 2.43 | 0.03 | 0.83 |

EXAMPLE 2

Table 3 shows chemical compositions of a material (material PS1) configuring the outer casing 111, and as a comparative example, chemical compositions of a material (material CS1) which is not in the range of chemical compositions according to the invention. The material PS1 is comprised of a cast steel having the range of the chemical compositions of the material (M3) configuring the above-described outer casing 111.

The material PS1 and the material CS1 undergone a prescribed heat treatment were heated at 600° C. for 10,000 hours and measured for a room-temperature 0.02% proof stress, an absorbed energy at 20° C. and a creep rupture strength at 600° C. for 100,000 hours.

Table 4 shows values obtained by dividing the values after heating in the individual measurements by the values before heating. Here, a value obtained by dividing the room-temperature 0.02% proof stress after heating at 600° C. for 10,000 hours by a room-temperature 0.02% proof stress before heating is determined as an index 1, a value obtained by dividing the absorbed energy at 20° C. after heating at 600° C. for 10,000 hours by an absorbed energy at 20° C. before heating is determined as an index 2, and a value obtained by dividing the creep rupture strength at 600° C. for 100,000 hours after heating at 600° C. for 10,000 hours by a creep rupture strength at 600° C. for 100,000 hours before heating is determined as an index 3.

It is seen from the results shown in Table 4 that the absorbed energy at 20° C. of the material PS1 after heating at 600° C. for 10,000 hours lowers to about ½ in comparison with that before heating, and the room-temperature 0.02% proof stress and the creep rupture strength at 600° C. for 100,000 hours are kept substantially at the same level as those before heating.

Meanwhile, the material CS1 which is not in the range of the chemical compositions according to the invention had the room-temperature 0.02% proof stress and the creep rupture strength at 600° C. for 100,000 hours largely lowered.

TABLE 3

| | Example PS1 | Comparative Example CS1 |
|---|---|---|
| C | 0.12 | 0.13 |
| Si | 0.21 | 0.21 |
| Mn | 0.25 | 0.77 |
| P | 0.011 | 0.009 |
| S | 0.008 | 0.004 |
| Ni | 0.31 | 0.17 |
| Cr | 9.71 | 1.15 |
| Mo | 0.71 | 0.97 |
| V | 0.20 | 0.24 |
| W | 1.77 | — |
| Nb | 0.04 | — |
| N | 0.025 | <0.01 |
| Al | — | <0.01 |
| Ti | 0.015 | 0.015 |
| B | 0.005 | — |
| Co | 2.67 | — |
| Cu | <0.01 | 0.18 |
| Fe | Balance | Balance |

TABLE 4

| | Index 1 | Index 2 | Index 3 |
|---|---|---|---|
| PS1 | 0.99 | 0.52 | 0.92 |
| CS1 | 0.71 | 2.15 | 0.45 |

It is seen from the measured results described in Example 1 and Example 2 that desired mechanical characteristics can be exerted, and the material having a successive change can also withstand an actual operation even if the above-described material configuring the turbine rotor 112, the inner casing 110 and the nozzle box 115 are exposed to a temperature of 650° C or more (700° C). It was found that, even if the material configuring the outer casing 111 is exposed to a temperature of 600° C, the desired mechanical characteristics can be exerted, and the material having the successive change can also withstand an actual operation. It is apparent from the above that the high-temperature steam of 650° C or more can be used as an operating fluid in the extra-high-pressure turbine 100 by configuring the prescribed configuration portions of the extra-high-pressure turbine 100 by the heat-resisting alloy or the cast steel which is within the chemical composition ranges of the above-described (M1) through (M3).

As described above, the steam turbine power generation system 10 of the first embodiment can introduce high-temperature steam of 650° C. or more into the extra-high-pressure turbine 100 and improve a thermal efficiency by forming the turbine rotor 112 of the extra-high-pressure turbine 100 by the heat-resisting alloy having the chemical composition range (M1), the inner casing 110 and the nozzle box 115 by the heat-resisting alloy having the chemical composition range (M2), and the outer casing 111, which is cooled by the outer casing cooling unit, by the cast steel having the chemical composition range (M3). Besides, reliability, operability and economical efficiency can be assured by having the outer casing cooling unit and configuring the outer casing 111 by the same ferrite-based alloy steel as a related art.

Second Embodiment

The steam turbine power generation system of a second embodiment has the same structure as that of the steam turbine power generation system 10 of the first embodiment except that the extra-high-pressure turbine 100 of the steam turbine power generation system 10 of the first embodiment is provided with a turbine rotor cooling unit for cooling the turbine rotor 112 by cooling steam, and the material configuring the turbine rotor 112 is changed.

Here, an extra-high-pressure turbine 100A of the steam turbine power generation system according to the second embodiment will be described. It should be noted that like parts which are same as those in the structure of the extra-high-pressure turbine 100 in the steam turbine power generation system 10 of the first embodiment are denoted by like reference numerals and overlapped descriptions thereof will be simplified or omitted. The steam turbine power generation system of the second embodiment has the extra-high-pressure turbine 100A instead of the extra-high-pressure turbine 100 of FIG. 1.

Figure 3:
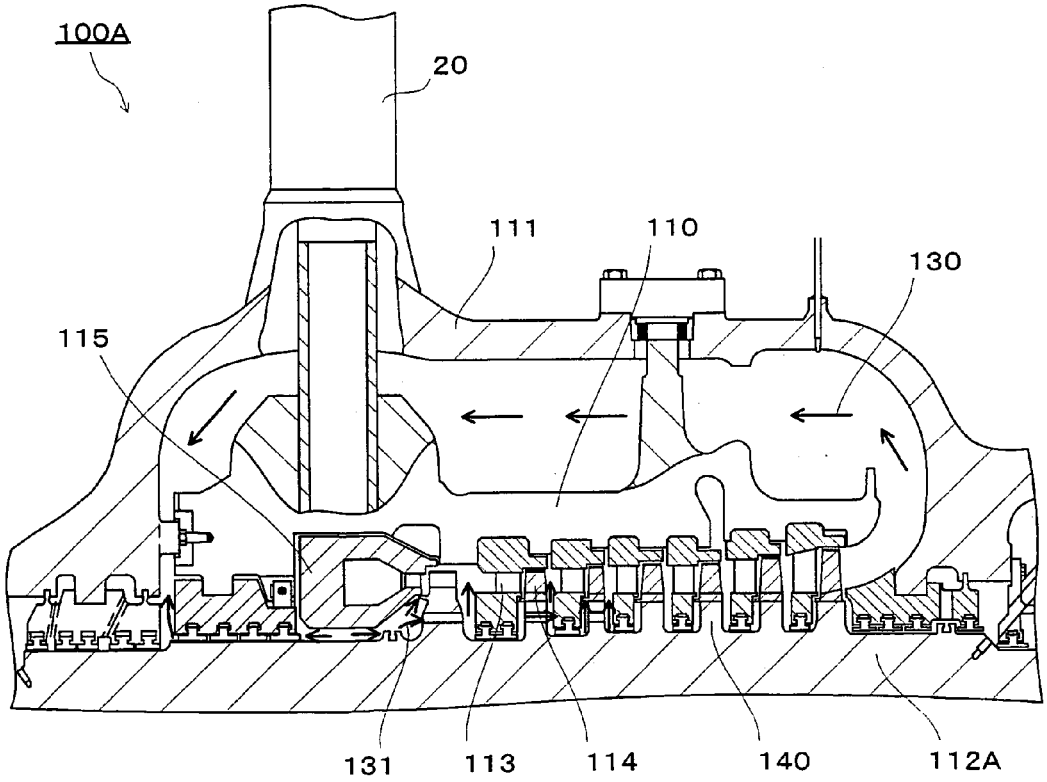
FIG. 3 is a sectional view of an upper-half casing portion of an extra-high-pressure turbine.

FIG. 3 shows a sectional view of the upper-half casing portion of the extra-high-pressure turbine 100A.

The extra-high-pressure turbine 100A has a double-structured casing which is configured of the inner casing 110 and the outer casing 111 disposed around it. A turbine rotor 112A is disposed through the inner casing 110. For example, the seven-stage nozzle 113 is disposed on the inner surface of the inner casing 110, and the moving blades 114 are implanted in the turbine rotor 112A. Besides, the main steam pipe 20 is disposed on the extra-high-pressure turbine 100A through the outer casing 111 and the inner casing 110, and one end of the main steam pipe 20 is connected to communicate with the nozzle box 115 which discharges steam toward the moving blades 114.

The extra-high-pressure turbine 100A is provided with an outer casing cooling unit for cooling the outer casing 111 by introducing part of the steam having performed the expansion work between the inner casing 110 and the outer casing 111 as the cooling steam 130. Besides, a cooling steam introducing portion (not shown) is disposed around the nozzle box 115, and a turbine rotor cooling unit is disposed to cool the turbine rotor 112A by flowing cooling steam 131 from the cooling steam introducing portion along the turbine rotor 112A.

As the cooling steam 131 for cooling the turbine rotor 112A, for example, steam which is extracted from the pipe in the boiler 700 communicated with the main steam pipe 20 and being heated before the introduction into the main steam pipe 20 is used. This steam is supplied to the periphery of the nozzle box 115 of the extra-high-pressure turbine 100A through a cooling steam pipe (not shown). It should be noted that the cooling steam 131 for cooling the turbine rotor 112A is not limited to the steam extracted from the pipe in the boiler 700 communicated with the main steam pipe 20, but steam of a temperature capable of cooling so that the turbine rotor 112A does not become a prescribed temperature or more can be used.

Subsequently, an operation of steam in the extra-high-pressure turbine 100A will be described.

Steam having a temperature of 650° C. or more which is flown into the nozzle box 115 within the extra-high-pressure turbine 100A through the main steam pipe 20 rotates the turbine rotor 112A after flowing through the steam passage between the nozzle 113 fixed to the inner casing 110 and the moving blades 114 implanted in the turbine rotor 112A. A large force is applied to the individual portions of the turbine rotor 112A by a great centrifugal action due to the rotations. And, the steam having performed the expansion work is mostly discharged and flown into the boiler 700 through the low-temperature reheating pipe 21. Meanwhile, the steam having performed the expansion work is partly guided as the cooling steam 130 between the inner casing 110 and the outer casing 111 to cool the outer casing 111. The cooling steam 130 is discharged from the ground portion or the discharge path where the steam having performed the expansion work is mostly discharged.

Meanwhile, the cooling steam 131 supplied to the periphery of the nozzle box 115 passes through a cooling steam passage hole 140 which is formed in a convex portion of the turbine rotor 112A, where the moving blades 114 are implanted, to cool the turbine rotor 112A to a prescribed stage. And, the cooling steam 131 having flown through the cooling steam passage hole 140 is exhausted from a gap portion between the nozzle 113 and the convex portion of the turbine rotor 112A to a steam passage.

And, the cooling steam 131 which is supplied to the periphery of the nozzle box 115 flows into a sealing portion, for example, a ground packing between the turbine rotor 112A and the inner casing 110 while cooling the turbine rotor 112A. And, the cooling steam 131 having passed through the sealing portion is discharged together with the cooling steam 130 having cooled the outer casing 111 from the ground portion or the discharge path where the steam having performed the expansion work is mostly discharged.

Cooling of the portion where the moving blades 114 of the turbine rotor 112A are implanted is not limited to the above method. Another method can also be adopted if it cools the portion, where the moving blades 114 of the turbine rotor 112A are implanted, by the cooling steam 131.

The cooling steam 131 is guided to the periphery of the nozzle box 115, so that the nozzle box 115 is also cooled, but the inner surface of the nozzle box 115 is directly exposed to the high-temperature steam, so that even if its outer circumferential surface is cooled by the cooling steam, it is desirably configured by a high-temperature resistance material, and the same material as that of the nozzle box 115 of the extra-high-pressure turbine 100 described in the first embodiment is used.

Then, the material configuring the turbine rotor 112A will be described. It should be noted that the ratio of chemical compositions shown below is expressed in "% by weight" unless otherwise specified.

For the material configuring the turbine rotor A112, a heat-resisting alloy (M4) having the following chemical composition range is used.

(M4) Heat-resisting steel which contains C: 0.08-0.15, Si: 0.1 or less, Mn: 0.1-0.3, Ni: 0.1-0.3, Cr: 9 or more and less than 10, V: 0.15-0.3, Mo: 0.4-1.0, W: 1.5-2.0, Co: 1.0-4.0, Nb: 0.05-0.08, B: 0.001-0.015, N: 0.01-0.04, and the balance of Fe and unavoidable impurities.

The turbine rotor 112A is cooled by the turbine rotor cooling unit, so that the above-described ferrite-based heat-resisting steel can be used. Examples of the heat-resisting steel having the basic components in the above-described range are described in, for example, Japanese Patent Laid-Open Application No.2004-359969 "heat-resisting steel which has a steel containing in percent by mass C: 0.08-0.15%, Si: 0.1% or less, Mn: 0.1-0.3%, Ni: 0.1-0.3%, Cr: 9% or more and less than 10%, V: 0.15-0.30%, Mo:0.6-1.0%, W:1.5-1.8%, Co:1.0-4.0%, Nb:0.05-0.08%, B:0.001-0.015%, N: 0.01-0.04% and the balance of Fe and unavoidable impurities undergone a tempering heat treatment, and has as main precipitates a $M_{23}C_6$ type carbide which is precipitated on grain boundary and martens ite lath boundary and an $M_2X$ type carbonitride and an MX type carbonitride which are precipitated within the martensite lath; wherein a total amount of the $M_{23}C_6$ type carbide, the $M_2X$ type carbonitride and the MX type carbonitride is in a range of 2.0-4.0% by mass; a V amount and an Mo amount contained in the $M_2X$ type carbonitride satisfy a relationship of V>Mo; and a total amount of an intermetallic compound precipitated under prescribed use conditions and the $M_{23}C_6$ type carbide, the $M_2X$ type carbonitride and the MX type carbonitride is in a range of 4.0-6.0% by mass" and "heat-resisting steel which has a steel, which contains in percent by mass C: 0.08-0.15%, Si: 0.1% or less, Mn: 0.1-0.3%, Ni: 0.1-0.3%, Cr: 9% or more and less than 10%, V: 0.15-0.30%, Mo: 0.4% or more and less than 0.6%, W: more than 1.8% and 2.0% or less, Co: 1.0-4.0%, Nb: 0.05-0.08%, B: 0.001-0.015%, N: 0.01-0.04% and the balance of Fe and unavoidable impurities, undergone a tempering heat treatment; and has as main precipitates a $M_{23}C_6$ type carbide precipitated on grain boundary and martensite lath boundary and $M_2X$ type carbonitride and MX type carbonitride which are precipitated within the martens ite lath; wherein a total amount of the $M_{23}C_6$ type carbide, the $M_2X$ type carbonitride and the MX type carbonitride is in a rang of 2.0-4.0% by mass; a V amount and an Mo amount contained in the $M_2X$ type carbonitride satisfy a relationship of V>Mo; and a total amount of an intermetallic compound precipitated under prescribed use conditions, the $M_{23}C_6$ type carbide, the $M_2X$ type carbonitride and the MX type carbonitride is in a range of 4.0-6.0% by mass."

Then, it will be described in Example 3 that desired mechanical characteristics can be exerted even if the material configuring the above-described turbine rotor 112A is exposed to a temperature of 600° C, and the material having a successive change can also withstand an actual operation. Here, the test temperature of the turbine rotor 112A is set to 600° C, because the turbine rotor 112A is cooled by the turbine rotor cooling unit, the desired mechanical characteristics can be exerted at a temperature of approximately 600° C, and the material having a successive change can also be resistant to an actual operation, so that it can be judged that the turbine rotor 112A can operate properly even if high-temperature steam of 650° C or more is introduced into the extra-high-pressure turbine 100A.

EXAMPLE 3

Table 5 shows chemical compositions of a material (material PS2) configuring the turbine rotor 112A and chemical compositions of a material (material CS2) as a comparative example which is not in the range of chemical compositions according to the invention. The material PS2 is formed of a heat-resisting steel which is in the range of chemical compositions of the material (M4) described above.

The material PS2 and the material CS2 undergone a prescribed heat treatment are heated at 600° C. for 10,000 hours and measured for a room-temperature 0.02% proof stress, an absorbed energy at 20° C. and a creep rupture strength at 600° C. for 100,000 hours.

Table 6 shows values obtained by dividing the values after heating in the individual measurements by the values before heating. Here, a value obtained by dividing the room-temperature 0.02% proof stress after heating at 600° C. for 10,000 hours by a room-temperature 0.02% proof stress before heating is determined as an index 1, a value obtained by dividing the absorbed energy at 20° C. after heating at 600° C. for 10,000 hours by an absorbed energy at 20° C. before heating is determined as an index 2, and a value obtained by dividing the creep rupture strength at 600° C. for 100,000 hours after heating at 600° C. for 10,000 hours by a creep rupture strength at 600° C. for 100,000 hours before heating is determined as an index 3.

It is seen from the results shown in Table 6 that the absorbed energy at 20° C. of the material PS2 after heating at 600° C. for 10,000 hours lowers to about ½ of that before heating, and the room-temperature 0.02% proof stress and the creep rupture strength at 600° C. for 100,000 hours are kept substantially at the same level as those before heating.

Meanwhile, the material CS2, which is not in the range of the chemical compositions according to the invention, has the room-temperature 0.02% proof stress and the creep rupture strength at 600° C. for 100,000 hours largely lowered.

TABLE 5

| | Example PS2 | Comparative Example CS2 |
|---|---|---|
| C | 0.11 | 0.29 |
| Si | 0.05 | 0.07 |
| Mn | 0.22 | 0.57 |
| P | 0.008 | 0.005 |
| S | 0.005 | 0.002 |
| Ni | 0.19 | 0.35 |
| Cr | 9.68 | 1.15 |

TABLE 5-continued

| | Example PS2 | Comparative Example CS2 |
|---|---|---|
| Mo | 0.67 | 1.34 |
| V | 0.21 | 0.29 |
| W | 1.81 | — |
| Nb | 0.04 | — |
| N | 0.002 | <0.01 |
| Al | — | <0.01 |
| Ti | — | <0.01 |
| B | 0.009 | — |
| Co | 2.88 | — |
| Cu | <0.01 | <0.01 |
| Fe | Balance | Balance |

TABLE 6

| | Index 1 | Index 2 | Index 3 |
|---|---|---|---|
| PS2 | 0.94 | 0.57 | 0.85 |
| CS2 | 0.69 | 2.85 | 0.50 |

It is seen from the measured results described in Example 3 that desired mechanical characteristics can be exerted, and the material having a successive change can also withstand an actual operation even if the material configuring the turbine rotor 112A is exposed to a temperature of 600° C. Thus, it is apparent that high-temperature steam of 650° C or more can be used as an operating fluid in the extra-high-pressure turbine 100A.

As described above, the steam turbine power generation system of the second embodiment can introduce the high-temperature steam of 650° C. or more into the extra-high-pressure turbine 100A and can improve a thermal efficiency by forming the turbine rotor 112A, which is cooled by the turbine rotor cooling unit in the extra-high-pressure turbine 100A, by the heat-resisting steel having the chemical composition range (M4), forming the inner casing 110 and the nozzle box 115 by the heat-resisting alloy having the chemical composition range (M2), and forming the outer casing 111 which is cooled by the outer casing cooling unit by the cast steel having the chemical composition range (M3). Besides, reliability, operability and economical efficiency can be assured by having the turbine rotor cooling unit and the outer casing cooling unit and configuring the turbine rotor 112A and the outer casing 111 by the same ferrite-based alloy steel as a related art.

Third Embodiment

The steam turbine power generation system of a third embodiment has the same structure as the steam turbine power generation system 10 of the second embodiment except that the extra-high-pressure turbine 100A is provided with an inner casing cooling unit which cools an inner casing 110B by cooling steam, and the material configuring the inner casing 110 is changed.

Here, an extra-high-pressure turbine 100B of the steam turbine power generation system of the third embodiment will be described. It should be noted that like parts which are same as those in the structure of the extra-high-pressure turbine 100A in the steam turbine power generation system of the second embodiment are denoted by like reference numerals and overlapped descriptions thereof will be simplified or omitted. And, the steam turbine power generation system of the third embodiment has the extra-high-pressure turbine 100B instead of the extra-high-pressure turbine 100 of FIG. 1.

Figure 4:
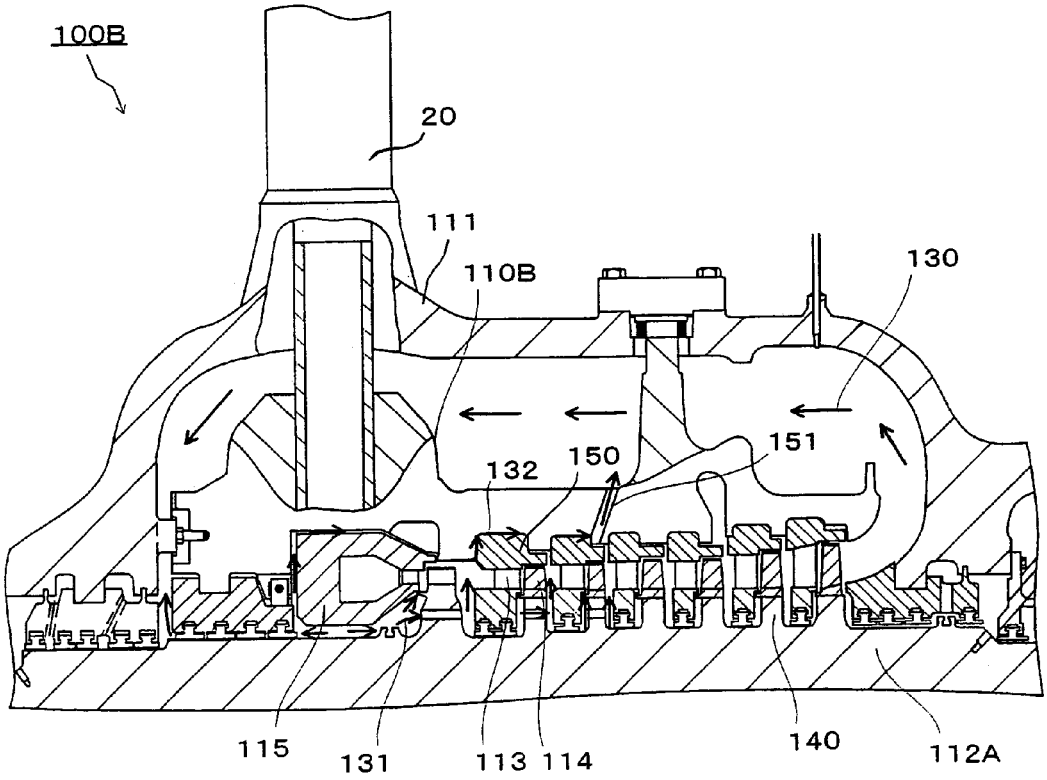
FIG. 4 is a sectional view of an upper-half casing portion of an extra-high-pressure turbine.

FIG. 4 shows a sectional view of the upper-half casing portion of the extra-high-pressure turbine 100B.

The extra-high-pressure turbine 100B is provided with a double-structured casing comprising the inner casing 110B and the outer casing 111 which is disposed around it. And,the turbine rotor 112A is disposed through the inner casing 110B. For example, the seven-stage nozzle 113 is disposed on the inner surface of the inner casing 110B, and the moving blades 114 are implanted in the turbine rotor 112A. Besides, the main steam pipe 20 is disposed on the extra-high-pressure turbine 100B through the outer casing 111 and the inner casing 110B. And, one end of the main steam pipe 20 is connected to communicate with the nozzle box 115 which discharges steam toward the moving blades 114.

The extra-high-pressure turbine 100B is provided with an outer casing cooling unit for cooling the outer casing 111 by introducing part of the steam having performed the expansion work between the inner casing 110B and the outer casing 111 as the cooling steam 130. And, in the same manner as in the second embodiment, the turbine rotor cooling unit is disposed to cool the turbine rotor 112A by guiding the cooling steam 131 to the periphery of the nozzle box 115 and flowing the cooling steam 131 along the turbine rotor 112A. Besides, the inner casing cooling unit is disposed to cool the inner casing 110B by flowing as cooling steam 132 part of the cooling steam 131, which is guided to the periphery of the nozzle box 115, to a gap of the joint of a nozzle diaphragm 150 and the inner casing 110B, and flowing through a cooling steam discharge passage 151 formed in the inner casing 110B. The outer casing cooling unit and the turbine rotor cooling unit are same as those described above, and the inner casing cooling unit will be described mainly here.

For the cooling steam 132 for cooling the inner casing 110B, part of the cooling steam 131 is used. For example, steam, which is extracted from a pipe in the boiler 700 communicated with the main steam pipe 20 and being heated before being introduced into the main steam pipe 20, is used as described above. This steam is supplied to the periphery of the nozzle box 115 of the extra-high-pressure turbine 100B through a cooling steam pipe (not shown). It should be noted that the cooling steam 131 is not limited to the steam which is extracted from the pipe in the boiler 700 communicated with the main steam pipe 20, but steam of a temperature capable of cooling so that the turbine rotor 112A or the inner casing 110B does not become a prescribed temperature or more can be used.

Subsequently, an operation of steam in the extra-high-pressure turbine 100B will be described.

Steam having a temperature of 650° C. or more, which is flown into the nozzle box 115 within the extra-high-pressure turbine 100B through the main steam pipe 20, rotates the turbine rotor 112A after flowing through the steam passage between the inner casing 110B and the turbine rotor 112A. A large force is applied to the individual portions of the turbine rotor 112A by the great centrifugal action due to the rotations. And, the steam having performed the expansion work is mostly discharged and flown into the boiler 700 through the low-temperature reheating pipe 21. Meanwhile, the steam having performed the expansion work is partly guided as the cooling steam 130 between the inner casing 110B and the outer casing 111 to cool the outer casing 111. The cooling steam 130 is discharged from the ground portion or the discharge path where the steam having performed the expansion work is mostly discharged.

Meanwhile, the cooling steam 131 which is supplied to the periphery of the nozzle box 115 passes through the cooling steam passage hole 140 which is formed in the convex portion of the turbine rotor 112A, where the moving blades 114 are implanted, to cool the turbine rotor 112A to a prescribed stage. And, the cooling steam 131 having flown through the cooling steam passage hole 140 is exhausted from the gap portion between the nozzle 113 and the convex portion of the turbine rotor 112A to a steam passage.

And, the cooling steam 131 which is supplied to the periphery of the nozzle box 115 flows into a sealing portion, for example, a ground packing between the turbine rotor 112A and the inner casing 110B while cooling the turbine rotor 112A. And, the cooling steam 131 having passed through the sealing portion is discharged together with the cooling steam 130 having cooled the outer casing 111 from the ground portion or the discharge path where the steam having performed the expansion work is mostly discharged.

Besides, the cooling steam 132 which is part of the cooling steam 131 supplied to the periphery of the nozzle box 115 flows through the gap between the nozzle diaphragm 150 and the inner casing 110B while cooling the inner casing 110B. And, the cooling steam 132 is flown through the cooling steam discharge passage 151, which is disposed downstream of the nozzle 113 at a prescribed stage of the inner casing 110B so as to communicate with the space between the inner casing 110B and the outer casing 111, and discharged together with the cooling steam 130 having cooled the outer casing 111 from the ground portion or the discharge path where the steam having performed the expansion work is mostly discharged.

Here, the inlet of the cooling steam discharge passage 151 is disposed downstream of the nozzle 113 at the prescribed stage in correspondence with a temperature of the steam which passes through a steam passage between the inner casing 110B and the turbine rotor 112A and rotates the turbine rotor 112A. For example, when the steam which rotates the turbine rotor 112A downstream of the nozzle 113 at the third stage has a temperature lower than an allowable temperature of the inner casing 110B, the inlet of the cooling steam discharge passage 151 is disposed downstream of the nozzle 113 at the third stage so as to cool the upstream of the nozzle 113 at the third stage.

The cooling steam 131 is guided to the periphery of the nozzle box 115, so that the nozzle box 115 is also cooled. But, the inner surface of the nozzle box 115 is directly exposed to the high-temperature steam, so that even if its outer circumferential surface is cooled by the cooling steam, it is desirably configured by a high-temperature resistance material, and the same material as that of the nozzle box 115 of the extra-high-pressure turbine 100 described in the first embodiment is used.

Then, the constituent material of the inner casing 110B will be described.

The inner casing 110B is cooled by the inner casing cooling unit, so that for the material configuring the inner casing 110B, a cast steel having the chemical composition range (M3) which is the same material as that configuring the outer casing of the extra-high-pressure turbine 100 of the first embodiment is used.

Here, because the inner casing 110B is cooled by the inner casing cooling unit, it can be judged that the inner casing 110B can operate properly even if high-temperature steam of 650° C or more is introduced into the extra-high-pressure turbine 100B if the desired mechanical characteristics can be exerted at a temperature of approximately 600° C and the material having a successive change is also resistant to an actual operation. Therefore, as described in Example 2 of the first embodiment, the desired mechanical characteristics can be exerted even if the (M3) material is exposed to a temperature of 600° C. Besides, it is apparent that the material having a successive change can also withstand an actual operation, so that it can be used as the material of the inner casing 110B even if the high-temperature steam of 650° C or more is introduced into the extra-high-pressure turbine 100B.

As described above, the steam turbine power generation system of the third embodiment can introduce the high-temperature steam of 650° C. or more into the extra-high-pressure turbine 110B and can improve a thermal efficiency by forming the turbine rotor 112A, which is cooled by the turbine rotor cooling unit in the extra-high-pressure turbine 100B, by the heat-resisting steel having the chemical composition range (M4), forming the inner casing 110B which is cooled by the inner casing cooling unit and the outer casing 111 which is cooled by the outer casing cooling unit by the cast steel having the chemical composition range (M3), and forming the nozzle box 115 by the heat-resisting alloy having the chemical composition range (M2). Besides, reliability, operability and economical efficiency can be assured by having the turbine rotor cooling unit, the inner casing cooling unit and the outer casing cooling unit and configuring the turbine rotor 112A, the inner casing 110B, and the outer casing 111 by the same ferrite-based alloy steel as the related art.

Fourth Embodiment

The steam turbine power generation system of a fourth embodiment has the high-pressure turbine 200 of the steam turbine power generation systems of the first through third embodiments provided with the turbine rotor cooling unit, the inner casing cooling unit and the outer casing cooling unit in the same manner as the extra-high-pressure turbine 100B of the third embodiment, wherein the turbine rotor, the inner casing and the outer casing of the high-pressure turbine 200 are formed of a ferrite-based alloy. High-temperature steam of 650° C. or more is introduced into the high-pressure turbine 200.

Here, as the cooling steam for cooling the turbine rotor and the inner casing of the high-pressure turbine 200, steam extracted from some midpoint stage of the extra-high-pressure turbines 100, 100A, 100B is used. This steam is supplied to the periphery of the nozzle box of the high-pressure turbine 200 through the cooling steam pipe. It should be noted that the cooling steam is not limited to the steam extracted from the midpoint stage of the extra-high-pressure turbines 100, 100A, 100B, but steam at a temperature capable of cooling such that the turbine rotor, the inner casing and the outer casing do not have a prescribed temperature or more can be used.

Then, the material configuring the turbine rotor, the inner casing and the outer casing of the high-pressure turbine 200 will be described.

For the turbine rotor, a heat-resisting steel having the chemical composition range (M4) which is the same material as that configuring the turbine rotor 112A of the extra-high-pressure turbine 100A of the second embodiment is used.

For the inner casing and the outer casing, the cast steel having the chemical composition range (M3) which is the same material as that configuring the outer casing of the extra-high-pressure turbine 100 of the first embodiment is used.

Because the inner surface of the nozzle box is directly exposed to high-temperature steam, it is desired to be formed of a material resistant to high temperatures even if its outer circumferential surface is cooled by the cooling steam, and the same material as the material of the nozzle box 115 of the extra-high-pressure turbine 100 described in the first embodiment is used.

Here, because the turbine rotor, the inner casing and the outer casing each are cooled by the cooling unit, it can be judged that the turbine rotor, the inner casing and the outer casing can operate properly even if high-temperature steam of 650° C or more is introduced into the high-pressure turbine 300 if the desired mechanical characteristics can be exerted at a temperature of approximately 600° C and the material having a successive change is also resistant to an actual operation. Therefore, as described in Example 2 of the first embodiment and Example 3 of the second embodiment, the desired mechanical characteristics can be exerted even if the (M3) and (M4) materials are exposed to a temperature of 600° C. Besides, it is apparent that the material having a temporal change can also withstand an actual operation, so that it can be used as the material of the turbine rotor, the inner casing and the outer casing even if the high-temperature steam of 650° C or more is introduced into the high-pressure turbine 300.

As described above, the steam turbine power generation system of the fourth embodiment can introduce the high-temperature steam of 650° C. or more into the extra-high-pressure turbine to improve the thermal efficiency and can introduce the high-temperature steam of 650° C. or more into the high-pressure turbine 200 and improve the thermal efficiency by forming the turbine rotor which is cooled by the turbine rotor cooling unit in the high-pressure turbine 200 by the heat-resisting steel having the chemical composition range (M4), forming the inner casing which is cooled by the inner casing cooling unit and the outer casing which is cooled by the outer casing cooling unit by the cast steel having the chemical composition range (M3), and forming the nozzle box by the heat-resisting alloy having the chemical composition range (M2). Besides, reliability, operability and economical efficiency can be assured by having the turbine rotor cooling unit, the inner casing cooling unit and the outer casing cooling unit, and configuring the turbine rotor, the inner casing and the outer casing by the same ferrite-based alloy steel as a related art.

Fifth Embodiment

The steam turbine power generation system of a fifth embodiment is provided with the turbine rotor cooling unit, the inner casing cooling unit and the outer casing cooling unit for the intermediate-pressure turbine 300 in the steam turbine power generation systems of the first through fourth embodiments in the same manner as the extra-high-pressure turbine 100B of the third embodiment and has the turbine rotor, the inner casing and the outer casing of the intermediate-pressure turbine 300 formed of a ferrite-based alloy. And, high-temperature steam of 650° C. or more is introduced into the intermediate-pressure turbine 300.

Here, as the cooling steam for cooling the turbine rotor and the inner casing of the intermediate-pressure turbine 300, steam which is extracted from some midpoint stage of the high-pressure turbine is used. This steam is supplied to the periphery of the nozzle box of the intermediate-pressure turbine 300 through the cooling steam pipe. It should be noted that the cooling steam is not limited to the steam which is extracted from the midpoint stage of the high-pressure turbine, but steam at a temperature capable of cooling such that the turbine rotor, the inner casing and the outer casing do not become a prescribed temperature or more can be used.

Then, the material configuring the turbine rotor, the inner casing and the outer casing of the intermediate-pressure turbine 300 will be described.

For the turbine rotor, a heat-resisting steel having the chemical composition range (M4) which is the same material as that configuring the turbine rotor 112A of the extra-high-pressure turbine 100A of the second embodiment is used.

For the inner casing and the outer casing, the cast steel having the chemical composition range (M3) which is the same material as that configuring the outer casing of the extra-high-pressure turbine 100 of the first embodiment is used.

Because the inner surface of the nozzle box is directly exposed to high-temperature steam, it is desired to be formed of a material resistant to high temperatures even if its outer circumferential surface is cooled by the cooling steam, and the same material as the material of the nozzle box 115 of the extra-high-pressure turbine 100 described in the first embodiment is used.

Here, because the turbine rotor, the inner casing and the outer casing each are cooled by the cooling unit, it can be judged that the turbine rotor, the inner casing and the outer casing can operate properly even if high-temperature steam of 650° C or more is introduced into the intermediate-pressure turbine 200 if the desired mechanical characteristics can be exerted at a temperature of approximately 600° C and the material having a successive change is also resistant to an actual operation. Therefore, as described in Example 2 of the first embodiment and Example 3 of the second embodiment, the desired mechanical characteristics can be exerted even if the (M3) and (M4) materials are exposed to a temperature of 600° C. Besides, it is apparent that the material having a successive change can also withstand an actual operation, so that it can be used as the material of the turbine rotor, the inner casing and the outer casing even if the high-temperature steam of 650° C or more is introduced into the intermediate-pressure turbine 200.

As described above, the steam turbine power generation system of the fifth embodiment can introduce the high-temperature steam of 650° C. or more into the extra-high-pressure turbine or the extra-high-pressure turbine and the high-pressure turbine to improve the thermal efficiency and can introduce the high-temperature steam of 650° C. or more into the intermediate-pressure turbine 300 and improve the thermal efficiency by forming the turbine rotor which is cooled by the turbine rotor cooling unit in the intermediate-pressure turbine 300 by the heat-resisting steel having the chemical composition range (M4), forming the inner casing which is cooled by the inner casing cooling unit and the outer casing which is cooled by the outer casing cooling unit by the cast steel having the chemical composition range (M3), and forming the nozzle box by the heat-resisting alloy having the chemical composition range (M4). Besides, reliability, operability and economical efficiency can be assured by having the turbine rotor cooling unit, the inner casing cooling unit and the outer casing cooling unit, and configuring the turbine rotor, the inner casing and the outer casing by the same ferrite-based alloy steel as the related art.

Sixth Embodiment

Figure 5:
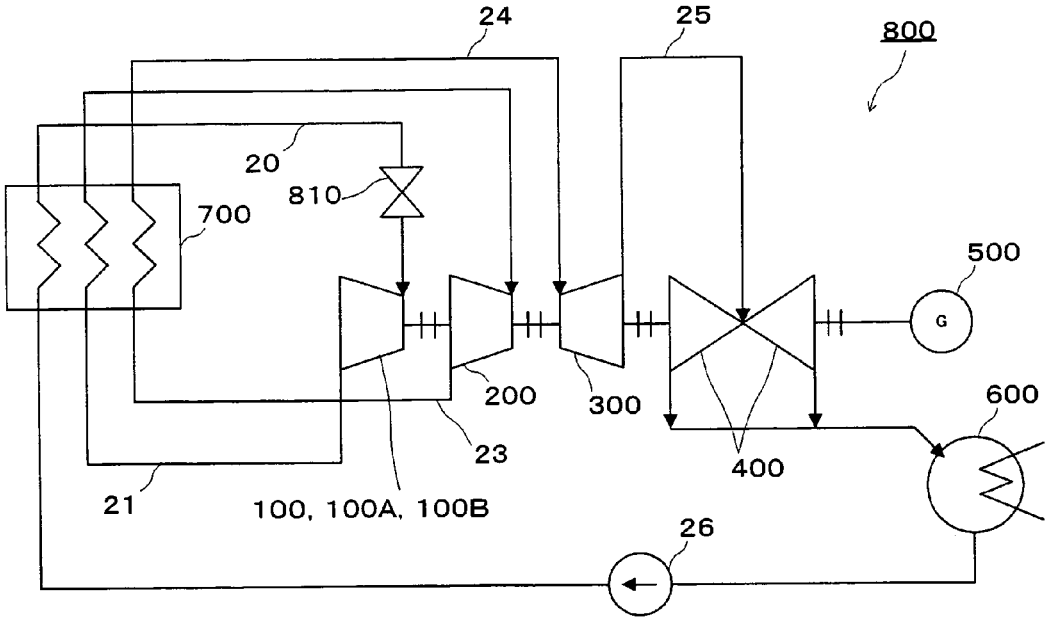
FIG. 5 is a diagram schematically showing an overview of the steam turbine power generation system according to a sixth embodiment of the present invention.

FIG. 5 shows schematically an overview of a steam turbine power generation system 800 of a sixth embodiment. It should be noted that like parts which are same as those in the structures of the steam turbine power generation systems of the first through fifth embodiments are denoted by like reference numerals and overlapped descriptions thereof will be simplified or omitted. The steam turbine power generation system 800 is provided with a steam valve 810 which is communicated with the high-temperature steam inlet portion of the extra-high-pressure turbines 100, 100A, 100B in the steam turbine power generation systems of the first through fifth embodiments. Steam, which is heated to a temperature of 650° C. or more by the boiler 700 and flown out, is flown into the extra-high-pressure turbines 100, 100A, 100B via the steam valve 810 through the main steam pipe 20.

Then, the material configuring the casing of the steam valve 810 will be described.

For the casing of the steam valve 810, a heat-resisting alloy having the chemical composition range (M2) which is the same material as that configuring the inner casing 110 and the nozzle box 115 of the extra-high-pressure turbine 100 of the first embodiment is used.

As described in Example 1 of the first embodiment, it is apparent that the desired mechanical characteristics can be exerted and the material having a successive change can also withstand an actual operation even if the (M2) material is exposed to a temperature of 650° C or more (700° C), so that the heat-resisting alloy can be used as the material of the casing of the steam valve 810 even if high-temperature steam of 650° C or more is introduced into the steam valve 810.

As described above, the casing of the steam valve 810 is formed of the heat-resisting alloy having the (M2) chemical composition range, so that a flow rate of the high-temperature steam can be adjusted by the steam valve 810 which is disposed at the high-temperature steam inlet portion of the extra-high-pressure turbines 100, 100A, 100B even if the high-temperature steam of 650° C. or more is introduced into the extra-high-pressure turbines 100, 100A, 100B.

In addition to the disposition of the steam valve 810 at the high-temperature steam inlet portion of the extra-high-pressure turbines 100, 100A, 100B, the steam valve 810 may be disposed at the high-temperature steam inlet portion of, for example, the high-pressure turbine 200 and the intermediate-pressure turbine 300. Especially, in a case where the high-temperature steam of 650° C. or more is introduced into the high-pressure turbine 200 and the intermediate-pressure turbine 300, it is possible to adjust the flow rate of the high-temperature steam by the steam valve 810 which is disposed at the high-temperature steam inlet portion of the high-pressure turbine 200 and the intermediate-pressure turbine 300.

It is to be noted that the present invention is not limited to the described embodiments and other expansions and modifications may be made without departing from the scope and sprit of the invention. All expanded or modified embodiments maybe made within the technical scope of the invention.

What is claimed is:

1. A steam turbine power plant which is provided with an extra-high-pressure turbine, a high-pressure turbine, an intermediate-pressure turbine and a low-pressure turbine, and has high-temperature steam of 650° C. or more introduced into the extra-high-pressure turbine;

wherein the extra-high-pressure turbine comprises:

a double-structured casing which is comprised of an outer casing and an inner casing; and an outer casing cooling unit which cools the outer casing by introducing cooling steam between the outer casing and the inner casing;

a turbine rotor of the extra-high-pressure turbine is formed of a heat-resisting alloy which contains in percent by weight C: 0.10-0.20, Si: 0.01-0.5, Mn: 0.01-0.5, Cr: 20-23, Co: 10-15, Mo: 8-10, Al: 0.01-1.5, Ti: 0.01-0.6, B: 0.001-0.006 and the balance of Ni and unavoidable impurities, and it is suppressed in the unavoidable impurities that Fe is 5 or less, P is 0.015 or less, S is 0.015 or less and Cu is 0.5 or less;

the inner casing and a nozzle box of the extra-high-pressure turbine are formed of a heat-resisting alloy which contains in percent by weight C: 0.03-0.25, Si: 0.01-1.0, Mn: 0.01-1.0, Cr: 20-23, Mo: 8-10, Nb: 1.15-3.0, and the balance of Ni and unavoidable impurities, and it is suppressed in the unavoidable impurities that Fe is 5 or less, P is 0.015 or less, S is 0.015 or less, and Cu is 0.5 or less; and the outer casing of the extra-high-pressure turbine is formed of a cast steel which contains in percent by weight C: 0.05-0.15, Si: 0.3 or less, Mn: 0.1-1.5, Ni: 1.0 or less, Cr: 9 or more and less than 10, V: 0.1-0.3, Mo: 0.6-1.0, W: 1.5-2.0, Co: 1.0-4.0, Nb: 0.02-0.08, B: 0.001-0.008, N: 0.005-0.1, Ti: 0.001-0.03 and the balance of Fe and unavoidable impurities.

2. A steam turbine power plant which is provided with an extra-high-pressure turbine, a high-pressure turbine, an intermediate-pressure turbine and a low-pressure turbine, and has high-temperature steam of 650° C or more introduced into the extra-high-pressure turbine;

wherein the extra-high-pressure turbine comprises:

a double-structured casing which is comprised of an outer casing and an inner casing;

an outer casing cooling unit which cools the outer casing by introducing cooling steam between the outer casing and the inner casing;

a turbine rotor cooling unit which cools a turbine rotor by the cooling steam;

a turbine rotor of the extra-high-pressure turbine is formed of a heat-resisting steel which contains in percent by weight C: 0.08-0.15, Si: 0.1 or less, Mn: 0.1-0.3, Ni: 0.1-0.3, Cr:9or more and less than 10, V: 0.15-0.3, Mo: 0.4-1.0, W: 1.5-2.0, Co: 1.0-4.0, Nb: 0.05-0.08, B: 0.001-0.015, N: 0.01-0.04 and the balance of Fe and unavoidable impurities;

the inner casing and a nozzle box of the extra-high-pressure turbine are formed of a heat-resisting alloy which contains in percent by weight C: 0.03-0.25, Si: 0.01-1.0, Mn: 0.01-1.0, Cr: 20-23, Mo: 8-10, Nb: 1.15-3.0 and the balance of Ni and unavoidable impurities, and it is suppressed in the unavoidable impurities that Fe is 5 or less, P is 0.015 or less, S is 0.015 or less, and Cu is 0.5 or less; and the outer casing of the extra-high-pressure turbine is formed of a cast steel which contains in percent by weight C: 0.05-0.15, Si: 0.3 or less, Mn: 0.1-1.5, Ni: 1.0 or less, Cr: 9 or more and less than 10, V: 0.1-0.3, Mo: 0.6-1.0, W: 1.5-2.0, Co: 1.0-4.0, Nb: 0.02-0.08, B: 0.001-0.008, N: 0.005-0.1, Ti: 0.001-0.03 and the balance of Fe and unavoidable impurities.

3. A steam turbine power plant which is provided with an extra-high-pressure turbine, a high-pressure turbine, an intermediate-pressure turbine and a low-pressure turbine, and has high-temperature steam of 650° C. or more introduced into the extra-high-pressure turbine;

wherein the extra-high-pressure turbine comprises:

a double-structured casing which is comprised of an outer casing and an inner casing;

an outer casing cooling unit which cools the outer casing by introducing cooling steam between the outer casing and the inner casing;

a turbine rotor cooling unit which cools a turbine rotor by the cooling steam;

an inner casing cooling unit which cools the inner casing by the cooling steam;

a turbine rotor of the extra-high-pressure turbine is formed of a heat-resisting steel which contains in percent by weight C: 0.08-0.15, Si: 0.1 or less, Mn: 0.1-0.3, Ni: 0.1-0.3, Cr: 9 or more and less than 10, V: 0.15-0.3, Mo: 0.4-1.0, W: 1.5-2.0, Co: 1.0-4.0, Nb: 0.05-0.08, B: 0.001-0.015, N: 0.01-0.04 and the balance of Fe and unavoidable impurities;

a nozzle box of the extra-high-pressure turbine is formed of a heat-resisting alloy which contains in percent by weight C: 0.03-0.25, Si: 0.01-1.0, Mn: 0.01-1.0, Cr: 20-23, Mo: 8-10, Nb: 1.15-3.0 and the balance of Ni and unavoidable impurities, and it is suppressed in the unavoidable impurities that Fe is 5 or less, P is 0.015 or less, S is 0.015 or less, and Cu is 0.5 or less; and the inner casing and the outer casing of the extra-high-pressure turbine are formed of a cast steel which contains in percent by weight C: 0.05-0.15, Si: 0.3 or less, Mn: 0.1-1.5, Ni: 1.0 or less, Cr: 9 or more and less than 10, V: 0.1-0.3, Mo: 0.6-1.0, W: 1.5-2.0, Co: 1.0-4.0, Nb: 0.02-0.08, B: 0.001-0.008, N: 0.005-0.1, Ti: 0.001-0.03 and the balance of Fe and unavoidable impurities.

4. The steam turbine power plant according to any one of claims 1 to 3, wherein the intermediate-pressure turbine, into which high-temperature steam of 650° C. or more is introduced comprises:

an intermediate-pressure outer casing cooling unit which cools the outer casing of the intermediate-pressure turbine;

an intermediate-pressure turbine rotor cooling unit which cools the turbine rotor of the intermediate-pressure turbine by the cooling steam;

an intermediate-pressure inner casing cooling unit which cools the inner casing of the intermediate-pressure turbine by the cooling steam; and an outer casing, the turbine rotor and the inner casing of the intermediate-pressure turbine are formed of a ferrite-based alloy.

5. The steam turbine power plant according to any one of claims 1 to 3;

wherein the high-pressure turbine, in which high-temperature steam of 650° C. or more is introduced comprises:

a high-pressure outer casing cooling unit which cools the outer casing of the high-pressure turbine;

a high-pressure turbine rotor cooling unit which cools the turbine rotor of the high-pressure turbine by the cooling steam;

a high-pressure inner casing cooling unit which cools the inner casing of the high-pressure turbine by the cooling steam; and an outer casing, the turbine rotor and the inner casing of the high-pressure turbine are formed of a ferrite-based alloy.

6. The steam turbine power plant according to any one of claims 1 to 3;

wherein the extra-high-pressure turbine, the high-pressure turbine and the intermediate-pressure turbine each are provided with a steam valve which is communicated with individual high-temperature steam introducing ports, and wherein a casing of the steam valve, which is disposed in at least the extra-high-pressure turbine, is formed of a heat-resisting alloy which contains in percent by weight C: 0.03-0.25, Si: 0.01-1.0, Mn: 0.01-1.0, Cr: 20-23, Mo: 8-10, Nb: 1.15-3.0 and the balance of Ni and unavoidable impurities, and it is suppressed in the unavoidable impurities that Fe is 5 or less, P is 0.015 or less, S is 0.015 or less, and Cu is 0.5 or less.

* * * * *